US011873063B1

(12) United States Patent
Boyd et al.

(10) Patent No.: US 11,873,063 B1
(45) Date of Patent: Jan. 16, 2024

(54) CLAMPING STORAGE DEVICE

(71) Applicant: Protomet Corporation, Oak Ridge, TN (US)

(72) Inventors: Stewart Boyd, Oak Ridge, TN (US); Nathan Mellas, Oak Ridge, TN (US); Brian Pitcher, Oak Ridge, TN (US); Lynn Haynes, Oak Ridge, TN (US); William Matthew Reid, Oak Ridge, TN (US); Jeff Bohanan, Oak Ridge, TN (US); Alec Stuckey, Oak Ridge, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 18/203,998

(22) Filed: May 31, 2023

Related U.S. Application Data

(60) Provisional application No. 63/365,660, filed on Jun. 1, 2022.

(51) Int. Cl.
*B63B 32/83* (2020.01)

(52) U.S. Cl.
CPC ..... *B63B 32/83* (2020.02)

(58) Field of Classification Search
CPC ..... B63B 32/83; B63B 32/80; B60R 9/048; B60R 9/08; B60R 9/12
See application file for complete search history.

(56) References Cited

U.S. PATENT DOCUMENTS 5,009,134 A 4/1991 Sorensen et al.
5,022,137 A 6/1991 Sorensen et al.
5,316,192 A 5/1994 Ng
6,886,795 B2 5/2005 Schultz
7,213,713 B2 5/2007 Matsui
7,770,859 B2 8/2010 Costabel et al.
7,866,620 B2 1/2011 Kaemmer
2007/0209567 A1* 9/2007 Fee ..... B63B 17/00 114/1
2008/0203260 A1 8/2008 Carnevali
2010/0230574 A1 9/2010 Ruan
2012/0280102 A1 11/2012 Liu
2013/0193176 A1* 8/2013 Khoo ..... B60R 9/08 224/324

(Continued)

OTHER PUBLICATIONS

Non-Final Office Action issued for U.S. Appl. No. 13/584,538, dated Jun. 19, 2013, 6 pages.

(Continued)

*Primary Examiner* — Andrew Polay
(74) *Attorney, Agent, or Firm* — Robinson IP Law, PLLC

(57) ABSTRACT

Various implementations include a sports board storage device. The device includes a housing, one or more linkages, a foot, and one or more linkage members. The housing has a first prong and a second prong. The one or more linkages are pivotably coupled to the first prong. The foot is pivotably coupled to the one or more linkages. The one or more linkage members are coupled to at least one of the one or more linkages. The one or more linkage members are movable relative to the housing to cause rotation of the one or more linkages and to cause the foot to move between a retracted position and an extended position. The foot is closer to the second prong in the extended position than it is in the retracted position.

21 Claims, 10 Drawing Sheets

(56) References Cited

U.S. PATENT DOCUMENTS

| | | | | |
|---|---|---|---|---|
| 2015/0158431 | A1* | 6/2015 | Parnell | B60R 9/08 211/85.7 |
| 2021/0261222 | A1* | 8/2021 | Hellweg | B63B 32/83 |
| 2022/0274534 | A1* | 9/2022 | Labbe | B62B 17/06 |

OTHER PUBLICATIONS

Final Office Action issued for U.S. Appl. No. 13/584,538, dated Jan. 30, 2014, 6 pages.

* cited by examiner

CLAMPING STORAGE DEVICE

FIELD

This disclosure relates to the field of mounts for sporting goods. More particularly, this disclosure relates to a storage device for securely holding board-type sporting goods.

BACKGROUND

Board-type sporting goods, such as surf boards and wakeboards, may be used in a variety of activities. For example, wakesurfing and wakeboarding have become popular watersports that may be performed behind a boat or other vessel. When not in use, it may be necessary to securely store sports boards such that the sports boards do not occupy significant space within a boat. For example, it may be desirable to store sports boards away from a floor of the boat to prevent the sports boards from occupying significant space on the boat and to prevent the sports boards from being stepped on or otherwise damaged when not in use.

Sports boards, such as wakeboards and wakesurf boards, may be difficult to transport when not in use. For example, sports boards may vary significantly in size. Wakesurf boards may vary significantly in thickness, with a thickness of a particular wakesurf board varying depending on the style of wakesurf board and stability of the wakesurf board. Further, thickness of a wakesurf board may vary significantly relative to other sports boards such as wakeboards.

Other difficulties may relate to securely holding the sports board during transportation. For example, sports boards may be stored on or around a tower of a boat when not in use. When one or more sports boards are stored on a vehicle such as a boat, it is important that the one or more sports boards are held securely in place to prevent the one or more sports boards from becoming dislodged during movement of the vehicle.

What is needed, therefore, is an improved device for securely holding or stowing sports boards on a vehicle, such as on a boat.

SUMMARY

The above and other needs are met by a storage device that provides improved holding of sports boards on the storage device. In one aspect, a sports board storage device includes: a body; a first prong extending from the body; a second prong extending from the body, the second prong substantially parallel to the first prong; a third prong extending from the body, the third prong substantially parallel to the first prong and the second prong; a first foot movably mounted on the first prong with a first linkage and a second linkage; a second foot movably mounted on the second prong with a first linkage and a second linkage; an intermediate linkage coupled with one of the first linkage and the second linkage of the first foot and with one of the first linkage and the second linkage of the second foot; a ratchet assembly coupled with the intermediate linkage; and a handle connected to the ratchet assembly. Actuation of the handle engages the ratchet assembly to move the first foot and the second foot towards extended positions on the storage device.

In some aspects, the techniques described herein relate to a sports board storage device including: a housing including a first prong extending therefrom and a second prong extending parallel to the first prong; a foot movably mounted on the first prong with a first linkage located towards a first end of the foot and a second linkage located towards a second end of the foot; one or more linkage members secured to one of the first linkage and the second linkage for moving one of the first linkage and the second linkage; wherein the foot, the first linkage, and the second linkage include a four-bar linkage such that the foot is movable between a retracted position and a extended position.

In some aspects, the techniques described herein relate to a sports board storage device including: a housing; a first prong extending from the housing; a second prong extending from the body, the second prong substantially parallel to the first prong; a third prong extending from the housing, the third prong substantially parallel to the first prong and the second prong; a first foot movably mounted on the first prong with a first linkage and a second linkage; a second foot movably mounted on the second prong with a first linkage and a second linkage; an intermediate linkage coupled with one of the first linkage and the second linkage of the first foot and with one of the first linkage and the second linkage of the second foot; a ratchet assembly coupled with the intermediate linkage; and a handle connected to the ratchet assembly; wherein actuation of the handle engages the ratchet assembly to move the first foot and the second foot towards extended positions on the storage device.

Various implementations include a sports board storage device. The device includes a housing, one or more linkages, a foot, and one or more linkage members. The housing has a first prong and a second prong. The one or more linkages are pivotably coupled to the first prong. The foot is pivotably coupled to the one or more linkages. The one or more linkage members are coupled to at least one of the one or more linkages. The one or more linkage members are movable relative to the housing to cause rotation of the one or more linkages and to cause the foot to move between a retracted position and an extended position. The foot is closer to the second prong in the extended position than it is in the retracted position.

In some implementations, the one or more linkages include a first linkage and a second linkage. In some implementations, the one or more linkage members are coupled to the first linkage. In some implementations, the second linkage member is a passive linkage.

In some implementations, the foot includes a resiliently flexible or deformable material.

In some implementations, the one or more linkages include a linkage spring for biasing the one or more linkages and foot toward the retracted position.

In some implementations, the one or more linkage members include an intermediate link member pivotably coupled to the one or more linkages and slidable relative to the housing. In some implementations, sliding of the intermediate link member causes the foot to move between the retracted position and the extended position. In some implementations, the one or more linkage members further include a drag link member. In some implementations, the drag link member couples the intermediate link member to the one or more linkages.

In some implementations, the device further includes a ratchet for causing the one or more linkage members to move relative to the housing. In some implementations, the ratchet includes a drum rotatable relative to the housing and a cable coupled to the one or more linkage members. In some implementations, rotation of the drum causes the cable to wind around the drum.

In some implementations, the ratchet further includes a ratchet member slidable relative to the housing. In some implementations, the ratcheting member is further rotatable relative to the housing between an engaged position and a disengaged position. In some implementations, the ratchet member is engaged with the drum such that sliding of the ratchet member causes rotation of the drum in the engaged position and the ratchet member is disengaged with the drum in the disengaged position.

In some implementations, the ratchet defines one or more teeth and the drum defines one or more teeth. In some implementations, the teeth of the ratchet member engage the teeth of the drum in the engaged position.

In some implementations, the ratchet further includes a handle coupled to the ratchet member.

In some implementations, the ratchet further includes a ratchet spring for biasing the ratchet member toward the engaged position.

In some implementations, the ratchet further includes a ratchet pin configured to contact the ratchet member when the ratchet member is slid relative to the housing. In some implementations, contact with the ratchet pin urges the ratchet member toward the disengaged position.

In some implementations, the ratchet further includes a release lever movable relative to the housing. In some implementations, the release lever is movable between a hold position and a release position. In some implementations, the release lever is engaged with the drum to allow rotation of the drum in a first rotational direct and prevent rotation of the drum in a second rotational direction in the hold position and the release lever is disengaged with the drum to allow rotation of the drum in the first rotational direct and the second rotational direction in the release position. In some implementations, the ratchet further includes a release lever spring for biasing the release lever toward the hold position.

In some implementations, the housing further includes a third prong. In some implementations, the one or more linkages are a first set of one or more linkages and the foot is a first foot. In some implementations, the device further includes a second set of one or more linkages and a second foot. In some implementations, the second set of one or more linkages pivotably is coupled to the second prong. In some implementations, the second foot is pivotably coupled to the second set of one or more linkages. In some implementations, the one or more linkage members are coupled to at least one of the one or more linkages of the second set of one or more linkages. In some implementations, the one or more linkage members are movable relative to the housing to cause rotation of the second set of one or more linkages and to cause the second foot to move between a retracted position and an extended position. In some implementations, the second foot is closer to the third prong in the extended position than it is in the retracted position.

In some implementations, the one or more linkage members include an intermediate link member pivotably coupled to the first set of one or more linkages and the second set of one or more linkages and slidable relative to the housing. In some implementations, sliding of the intermediate link member causes the first foot and the second foot to move between the retracted positions and the extended positions.

In some implementations, the intermediate link member has a first portion, a second portion spaced apart from the first portion, and an intermediate portion located between the first portion and the second portion. In some implementations, the first set of linkages is pivotably coupled to the first portion and the second set of linkages pivotably coupled to the second portion. In some implementations, the intermediate link member is pivotable about the intermediate portion relative to the housing.

In some implementations, the first prong is spaced apart from the second prong. In some implementations, a sports board is disposable between the first prong and the second prong such that movement of the foot from the retracted position to the extended position causes the foot to contact the sports board and secure the sports board between the foot and the second prong.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
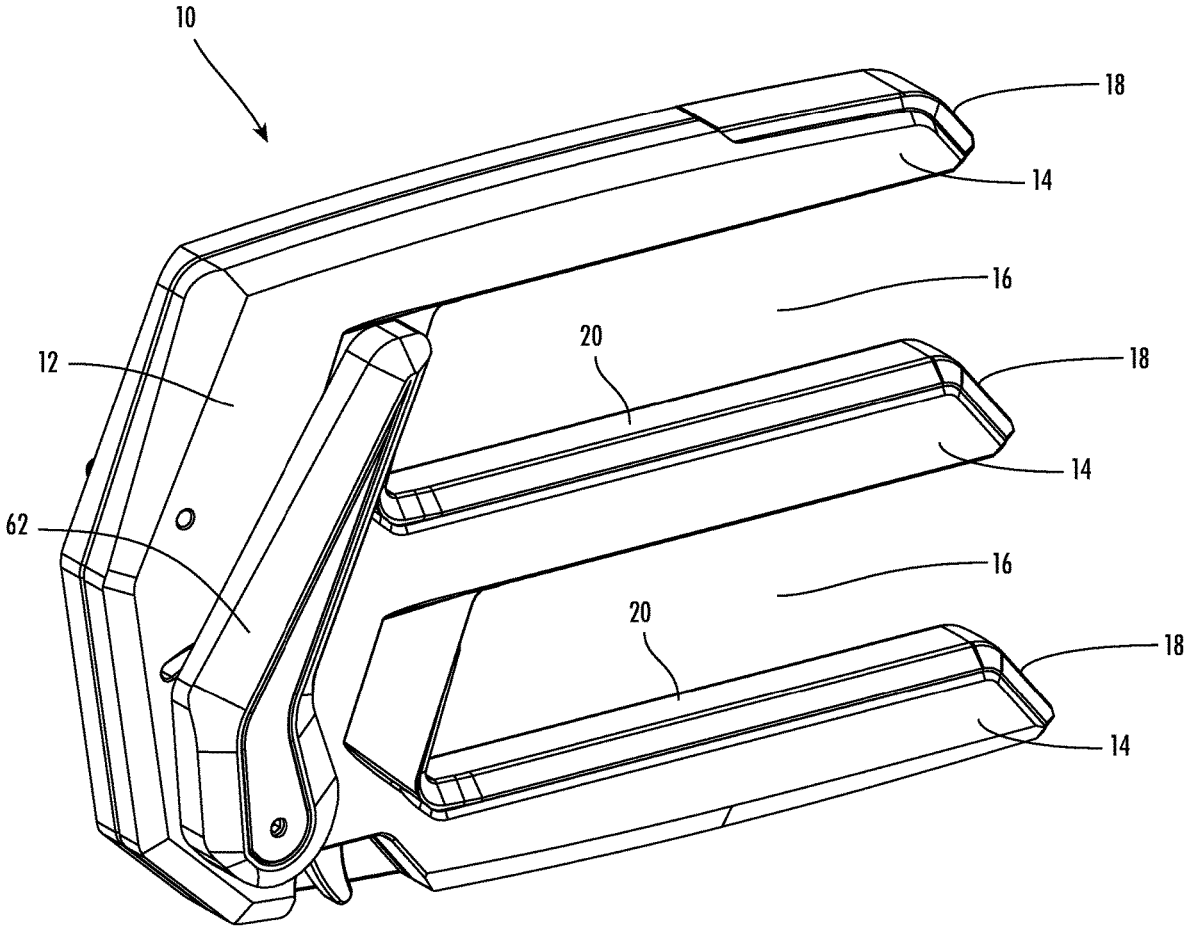
FIG. 1 shows a perspective view of a storage device.

FIG. 1 illustrates a storage device 10 for securely holding a sports board, such as a wakeboard or wakesurf board. The storage device 10 includes a housing 12 that includes a plurality of prongs 14 extending therefrom. The plurality of prongs 14 define one or more spaces 16 formed between the plurality of prongs 14 that are shaped to receive at least a portion of a sports board therein. One or more sports boards may be clamped on the storage device 10 between the plurality of prongs 14 and within the one or more spaces 16 to securely retain the one or more sports boards on the storage device 10. As described herein, the storage device 10 may include a first prong 14A, a second prong 14B, and a third prong 14C. The storage device 10 shown and described herein may be arranged to transport two sports boards. However, it is also understood that a number of the prongs 14 may vary such that the storage device 10 may be capable of carrying less than or more than two sports boards.

The prongs 14 may extend substantially horizontally from the housing 12 of the storage device 10 or may be at least partially inclined or angled relative to the housing 12 or a surface on which the storage device 10 is mounted. The prongs 14 may extend substantially parallel to one another along lengths of the prongs 14, as shown in FIG. 1. The prongs 14 may include a sloped end portion 18 located at ends of the prongs 14. The sloped end portion 18 of the prongs 14 may be shaped to aid in guiding a sports board into the one or more spaces 16 formed between the prongs 14 when placing the sports board onto the storage device 10. The prongs 14 may include a resiliently flexible portion 20 located on at least a portion of the prongs 14. The resiliently flexible portion 20 may be formed of a rubber, foam, or other resiliently flexible material for contacting a surface of a sports board without causing damages to the sport board. The resiliently flexible portion 20 may extend along a length of an upper surface of the prongs 14 and may further extend towards and over the sloped end portion 18 of the prongs 14.

Figure 2:
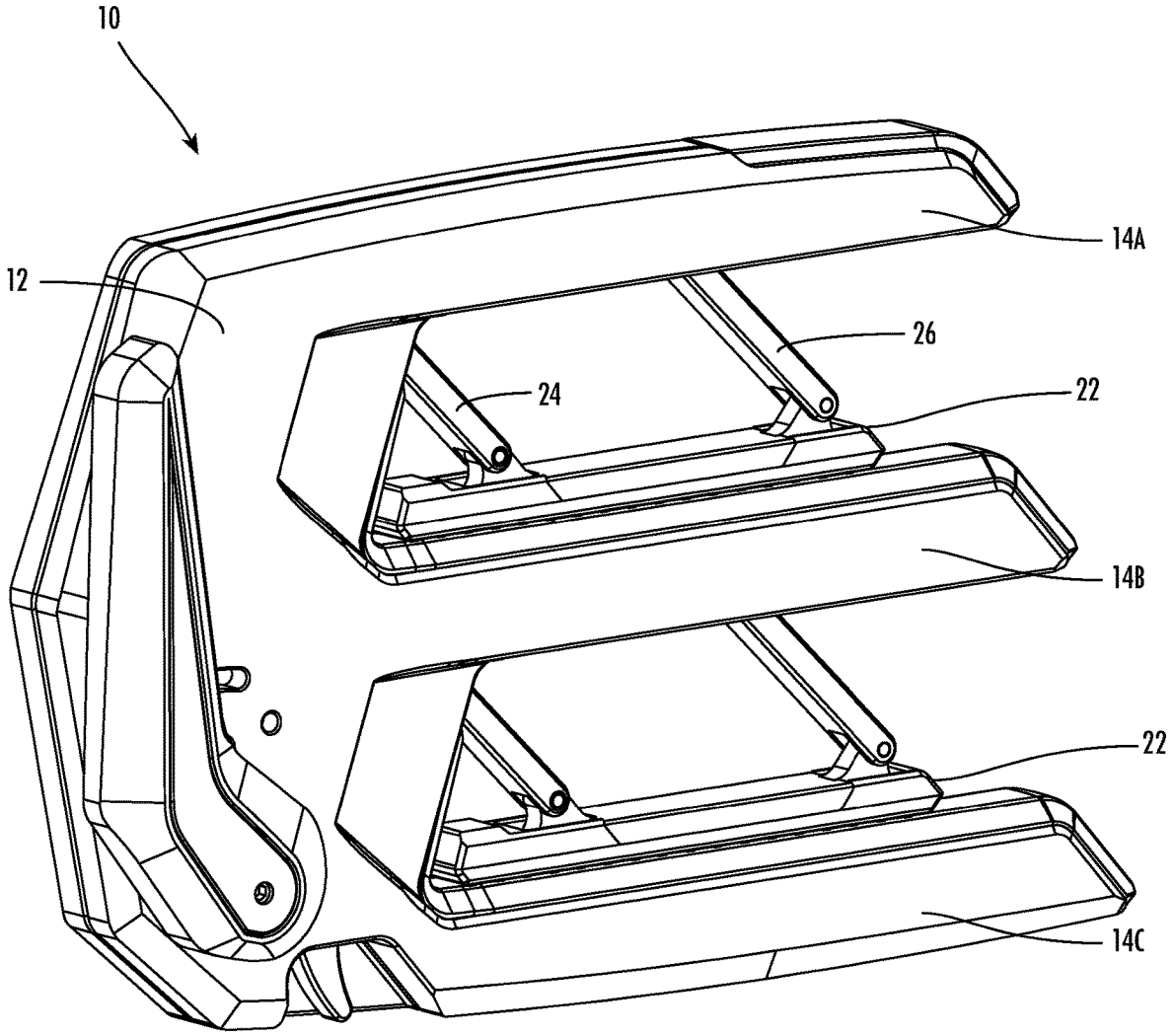
FIG. 2 shows a perspective view of a storage device with one or more feet in extended positions.
Figure 4:
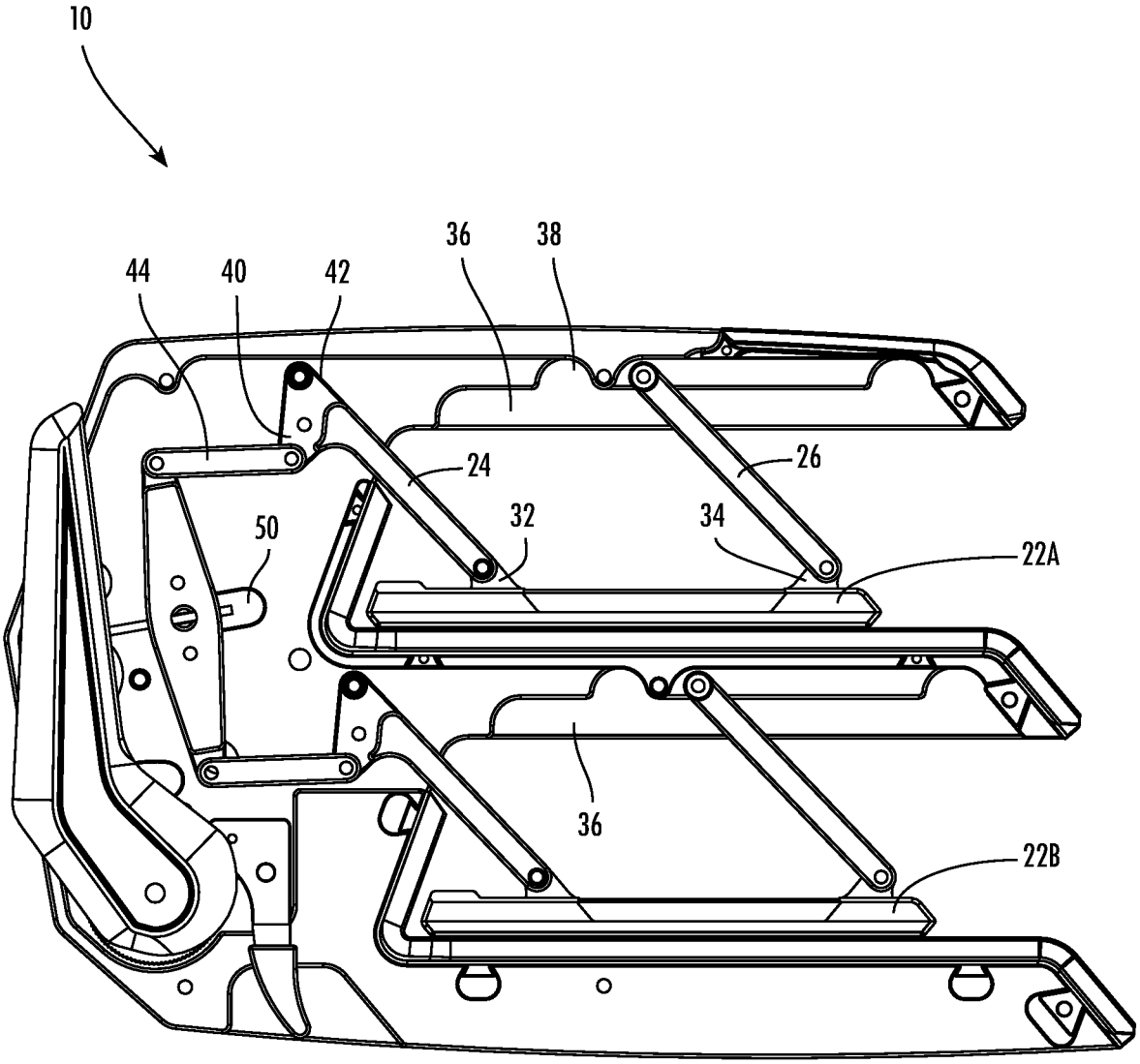
FIG. 4 shows a cross-sectional side view of a storage device with one or more feet in extended positions.

Referring to FIG. 2, the storage device 10 includes one or more feet 22 movably mounted on the housing 12. The one or more feet 22 are movably mounted on the housing 12 such that the one or more feet 22 move between a retracted position (FIG. 1) and an extended position, which is shown in FIG. 2. The one or more feet 22 may be elongate such that the one or more feet 22 fit along at least a partial length of the prongs 14. The storage device 10 may include two of the one or more feet 22 as shown in the figures, including a first foot 22A and a second foot 22B (FIG. 4). However, it is also understood that the storage device 10 may include a single of the one or more feet 22 or may include more than two of the one or more feet 22 on the storage device 10 depending on a number of the prongs 14 on the storage device 10 and a number of sports boards to be secured on the storage device 10. The one or more feet 22 may be formed or coated with a resiliently flexible or deformable material along portions of the one or more feet 22 that may contact a sports board to prevent damage to the sports board when secured on the storage device 10 as described herein. In some implementations, the resiliently flexible or deformable material includes a friction or non-slip material.

Figure 3:
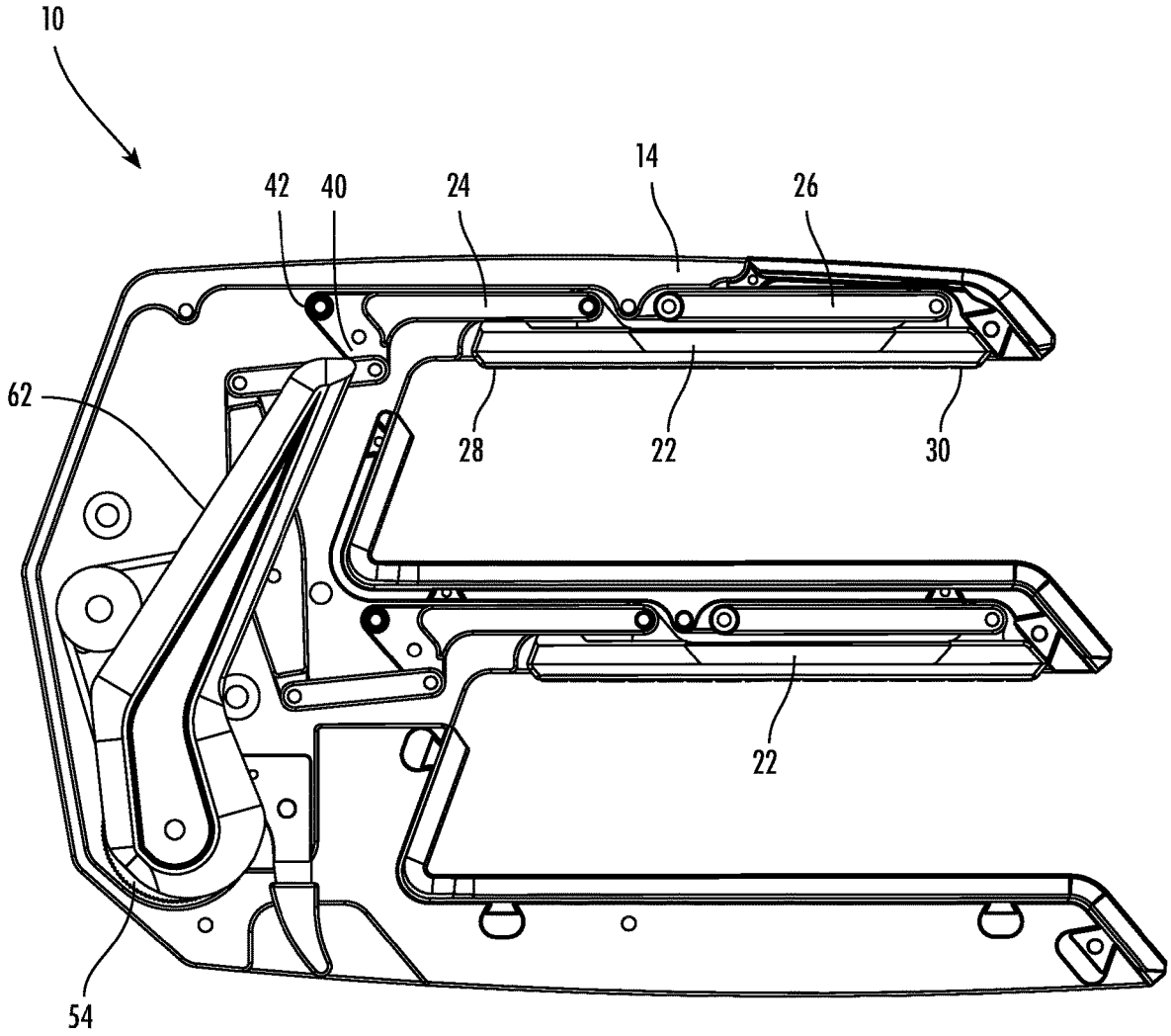
FIG. 3 shows a cross-sectional side view of a storage device with one or more feet in retracted positions.

The one or more feet 22 may be supported on the prongs 14 of the storage device 10 with a first linkage 24 and a second linkage 26. FIG. 3 shows the one or more feet 22 in a retracted position, as described in greater detail below. The first linkage 24 may be pivotally mounted at an end of the first linkage 24 to the one or more feet towards a first end 28 of the one or more feet 22, as shown in FIG. 3. The second linkage 26 may be pivotally mounted at an end of the second linkage 26 towards a second end 30 of the one or more feet 22. FIG. 4 shows the one or more feet 22 in an extended position, as described in greater detail below. The first linkage 24 may be pivotally mounted towards the first end 28 of the one or more feet 22 at a first tab 32 located on the one or more feet. The second linkage 26 may be pivotally mounted towards the second end 30 of the one or more feet 22 at a second tab 34. The first tab 32 and the second tab 34 may project upwardly from a top surface of the one or more feet 22. The first linkage 24 and the second linkage 26 may be pivotally mounted to the housing 12 of the storage device 10, such as along the prongs 14. The first linkage 24 and the second linkage 26 may be pivotally mounted to the housing 12 and to the one or more feet 22 such that the one or more feet 22, the first linkage 24, and the second linkage 26 form a four-bar linkage assembly.

The one or more feet 22 are movable on the storage device 10 between retracted positions, as shown in FIG. 3, and extended positions, as shown in FIG. 4. The prongs 14, such as the first prong 14A and the second prong 14B, may include a recessed portion 36 (FIG. 4) that is shaped to receive the one or more feet 22 at least partially therein, as shown in FIG. 3. The recessed portion 36 may include one or more contours 38 that are shaped to receive portions of the one or more feet 22. For example, the one or more contours 38 may be shaped to receive the first tab 32 and the second tab 34 located on the one or more feet 22 when the one or more feet are in retracted positions. The first linkage 24 and the second linkage 26 allow the one or more feet 22 to move between the retracted position and the extended position while maintaining an orientation of the one or more feet 22. As shown in FIGS. 3 and 4, the one or more feet 22 may be substantially parallel to the prongs 14 in the retracted position, extended position, and positions therebetween.

The first linkage 24 may further include a linkage tab 40. The linkage tab 40 may be located on the first linkage 24, such as at an end of the first linkage 24 that is distal from an end of the first linkage 24 secured to the one or more feet 22. A linkage spring 42 may be coupled with the first linkage 24, such as at the linkage tab 40. The linkage spring 42 may be mounted between the first linkage 24 and a portion of the housing 12. The linkage spring 42 is oriented such that the one or more feet 22 are biased towards a retracted position, as shown in FIG. 3.

Figure 5:
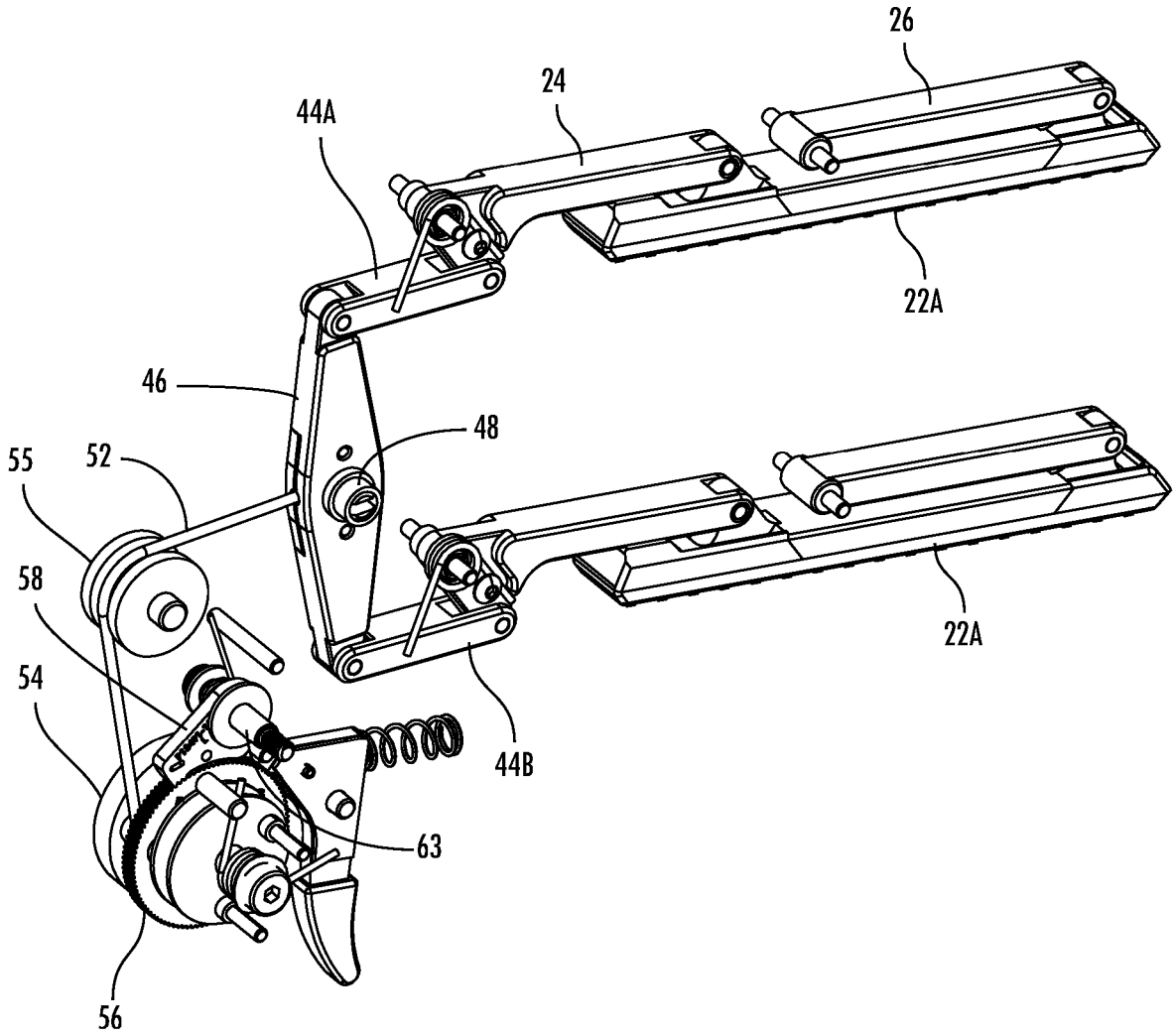
FIG. 5 shows a ratchet and linkage assembly of a storage device.
Figure 6:
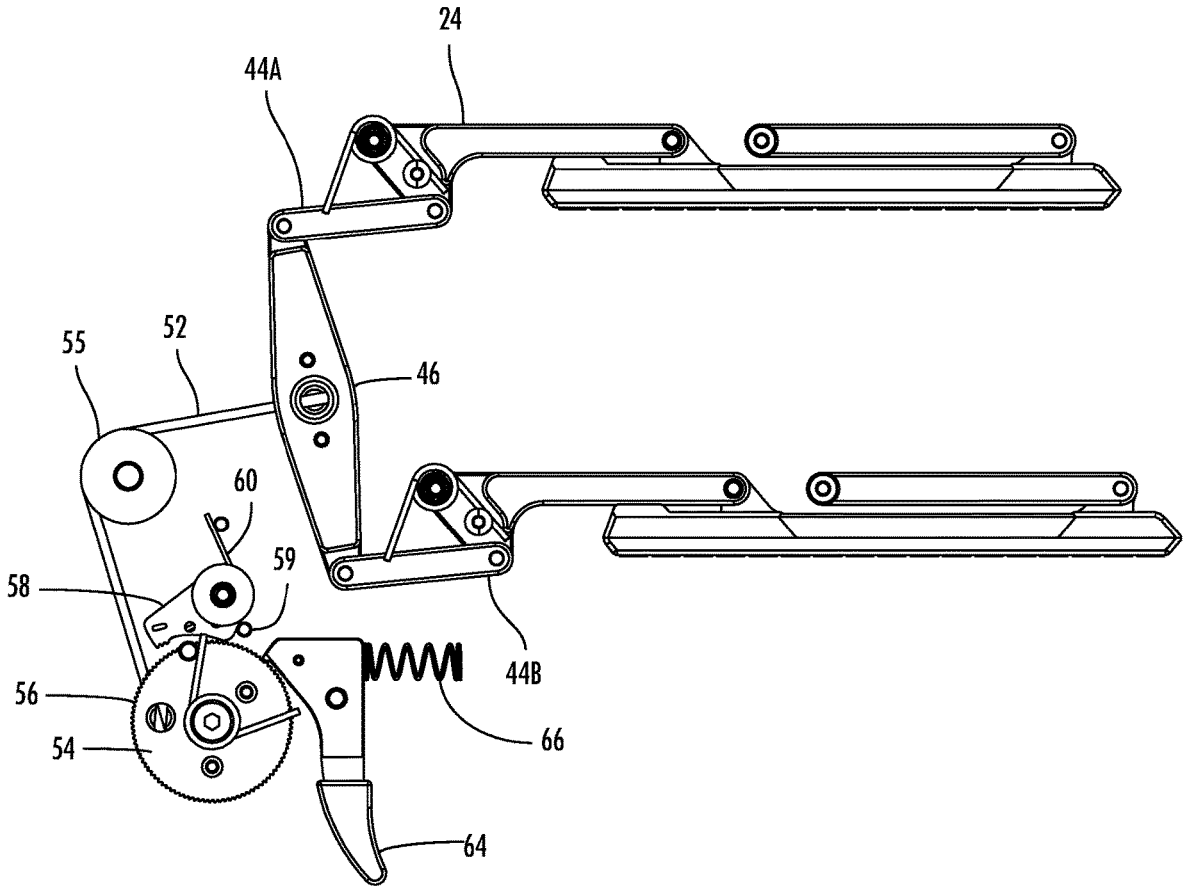
FIG. 6 shows a side view of a ratchet and linkage assembly of a storage device with one or more feet in retracted positions.

One or more drag link members 44 are pivotally coupled with the first linkage 24, such as at the linkage tab 40 of the first linkage 24. As shown in the figures, the storage device 10 may include a pair of the one or more drag link members 44, including a first drag link member 44A and a second drag link member 44B (FIG. 5). Referring to FIG. 6, the one or more drag link members 44 may be pivotally coupled with the linkage tab 40 of the first drag link member 44A for each of the one or more feet 22. The one or more drag link members 44 may be coupled with an intermediate link member 46. The one or more drag link members 44 may be pivotally coupled with the intermediate link member 46, such as towards end portions of the intermediate link member 46. As shown in FIG. 5, the first drag link member 44A may be pivotally coupled with the intermediate link member 46 at a first end of the intermediate link member 46 and the second drag link member 44B may be pivotally coupled with the intermediate link member 46 at a second end of the intermediate link member 46.

The intermediate link member 46 is arranged on the housing 12 of the storage device 10 such that the intermediate link member 46 is movable relative to the housing 12. An intermediate portion between the end portions of the intermediate link member 46 may be mounted on the housing 12 such that the intermediate link member 46 may slide or translate relative to the housing 12. Further, the intermediate link member 46 may pivot about the intermediate portion relative to the housing 12. The intermediate link member 46 may include a projecting portion 48 extending from the intermediate portion. The projecting portion 48 may be shaped to engage a slot 50 (FIG. 4) such that the projecting portion 48 engages and slides along a length of the slot 50 when the one or more feet 22 move between extended and retracted positions.

A cable 52 is secured to the intermediate link member 46. The cable 52 may be secured to the intermediate link member 46 at a center of the intermediate link member 46. The cable 52 may be formed of a wire, strap, or other member for moving the intermediate link member 46 as described in greater detail herein. The cable 52 extends from an end at the intermediate link member 46 to a drum 54 rotatably mounted on the storage device 10. The drum 54 is shaped to wind a portion of the cable 52 around the drum 54 and to pull the cable 52 around the drum 54 when the one or more feet 22 are moved to extended positions. The cable 52 may extend around a pulley 55 located between the intermediate link member 46 and the drum 54.

The storage device includes a ratchet that includes the drum 54, a ratchet member 58, a ratchet spring 60, a handle 62, a ratchet pin 59, a release lever 64, and a release lever spring 66. The drum 54 may be rotatably mounted on the housing 12. The drum 54 may include a toothed portion 56 that may be located around an outer edge of the drum 54. The toothed portion 56 is shaped to engage the ratchet member 58 to allow the drum 54 to ratchet with respect to the ratchet member 58. The ratchet member 58 may include one or more teeth formed on an end thereof that are shaped to engage the toothed portion 56 of the drum 54. The ratchet member 58 may further include the ratchet spring 60 (FIG. 6) coupled with the ratchet member 58. The ratchet spring 60 may bias the ratchet member 58 towards contact with the toothed portion 56 of the drum 54. The ratchet member 58 may be movably mounted on the storage device 10 such that movement of the ratchet member 58 induces movement in the drum 54 to move the one or more feet 22 from retracted positions to extended positions.

Referring again to FIG. 3, the handle 62 is coupled with or connected to the drum 54 such that actuation of the handle 62 rotates the drum 54 as discussed in greater detail herein. The handle 62 may further be coupled with the ratchet member 58. The handle 62 may be rotatably mounted on the storage device 10 such that the handle 62 may move the ratchet member between a disengaged position as shown in FIG. 3 and an engaged position as shown in FIG. 4. The ratchet member is engaged with the drum such that sliding of the ratchet member causes rotation of the drum in the engaged position. The ratchet member is disengaged with the drum in the disengaged position.

Figure 7:
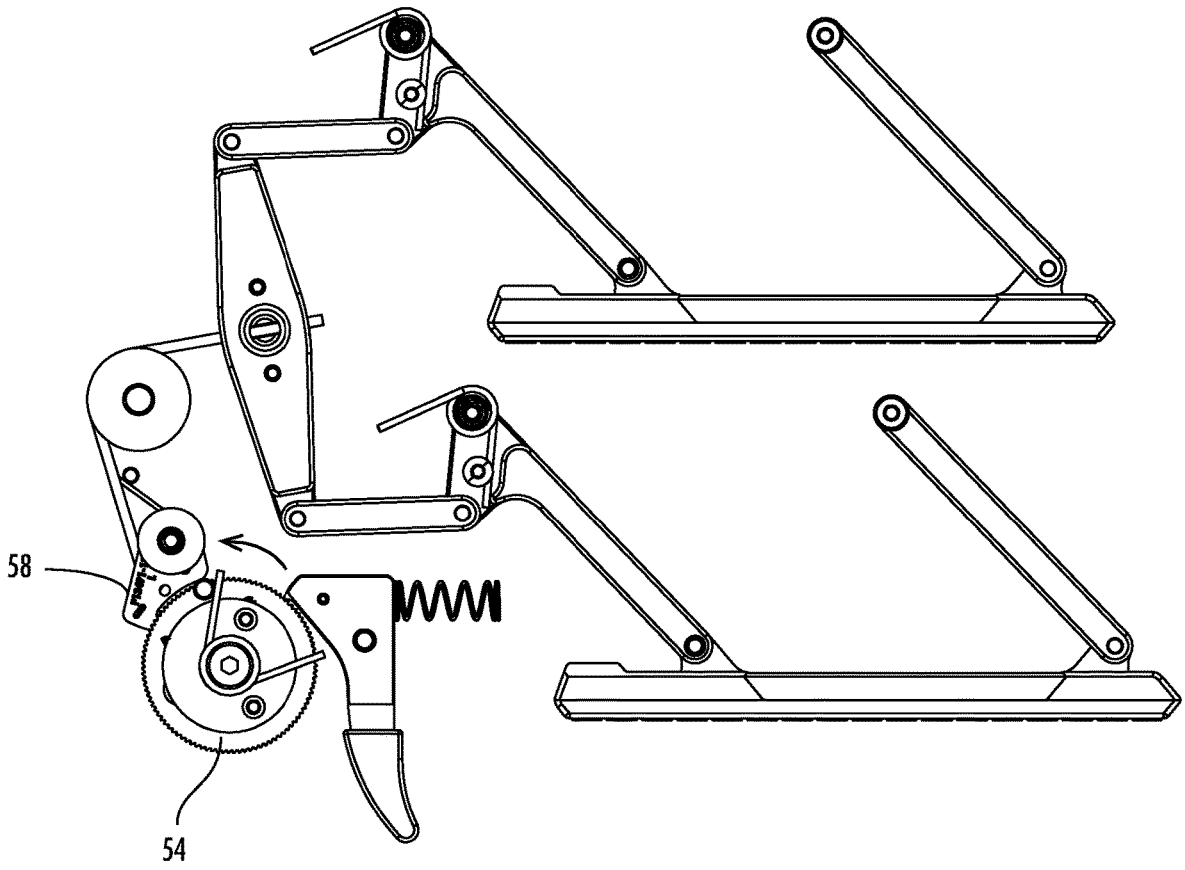
FIG. 7 shows a side view of a ratchet and linkage assembly of a storage device with one or more feet in extended positions.

Referring to FIG. 5, the ratchet member 58 may include a post 63 extending from the ratchet member 58. The handle 62 is secured on the post 63 such that when the handle 62 pivots relative to the storage device 10, the ratchet member 58 moves between a disengaged position as shown in FIG. 6 and an engaged as shown in FIG. 7. As the ratchet member 58 moves between the disengaged position and the engaged position, the ratchet member 58 engages the toothed portion 56 of the drum 54 to cause the drum 54 to rotate an amount corresponding to movement of the ratchet member 58 from the disengaged position to the engaged position. When the handle 62 is released, the ratchet member 58 is shaped such that the ratchet member 58 returns to the disengaged position without engaging the toothed portion 56 of the drum 54 to allow the ratchet member 58 to return to the disengaged position without causing the drum 54 to rotate or otherwise return to an original position.

Referring to FIG. 6, the ratchet pin 59 may be mounted on the storage device 10 and arranged to contact the ratchet member 58 when the ratchet member 58 is in the disengaged position. When the ratchet member 58 is in the disengaged position, the ratchet member 58 may be located adjacent to the ratchet pin 59. The ratchet pin 59 may contact a portion of the ratchet member 58 to cause the ratchet member 58 to pivot with respect to the drum 54, thereby disengaging the ratchet member 58 from the toothed portion 56 of the drum 54. When the handle 62 is engaged, the ratchet member 58 disengages from the ratchet pin 59 and the ratchet spring urges the ratchet member 58 into contact with the toothed portion 56 of the drum 54.

The release lever 64 is movably mounted on the storage device proximate to the drum 54. The release lever is movable between a hold position and a release position. The release lever 64 may include a portion that contacts the toothed portion 56 of the drum 54 in the hold position. The release lever 64 is biased into contact with the toothed portion 56 of the drum 54 with the release lever spring 66 in the hold position such that the release lever 64 permits the drum 54 to rotate in a first rotational direct and prevent rotation of the drum in an opposite, second rotational direction in the hold position. The release lever 64 may be pivotally or otherwise movably mounted on the storage device 10 proximate to the drum 54 such that when the release lever 64 is moved to the release position the release lever 64 is disengaged from the drum 54, thereby allowing the drum 54 to rotate freely in the first rotational direct and the second rotational direction.

The storage device 10 is configured to retain an object, such as a sports board, on the storage device 10. The storage device 10 may retain a sports board between the one or more feet 22 when the one or more feet 22 are extended and a portion of the prongs 14. In a retracted position, as shown in FIG. 3, the one or more feet 22 may be at least partially retracted into the prongs 14 and the one or more feet 22 are withdrawn from the prongs 14 such that a space is available to insert an object such as a sports board. In an extended position, as shown in FIG. 4, the one or more feet 22 may be deployed such that the one or more feet 22 move towards the prongs 14 below the one or more feet 22. To move the one or more feet 22, the handle 62 is engaged to ratchet the drum 54 and subsequently move the intermediate link member 46. The intermediate link member 46 causes the first linkage to rotate and thereby move the one or more feet 22 towards extended positions shown in FIG. 4.

Figure 8:
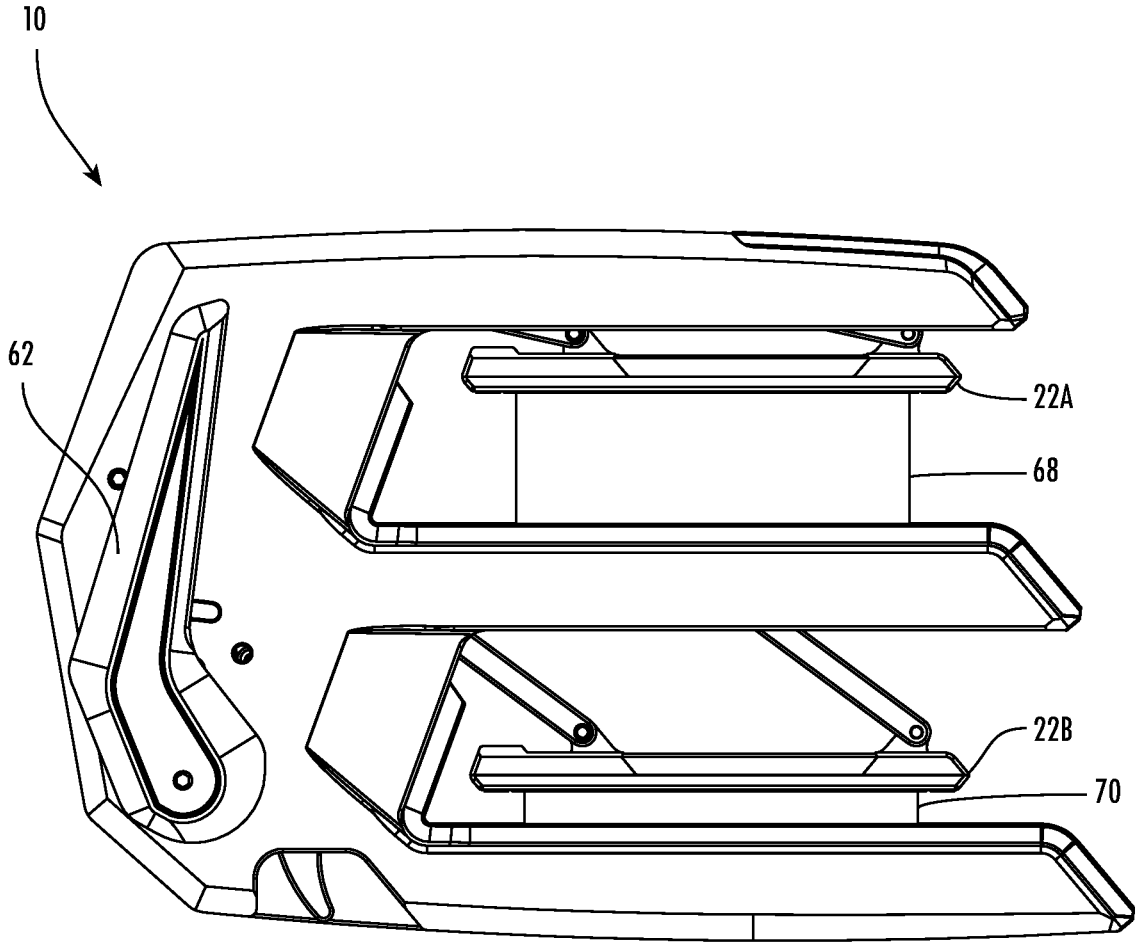
FIGS. 8 and 9 show side views of a storage device engaged with a first sports board and a second sports board having varying thicknesses.
Figure 9:
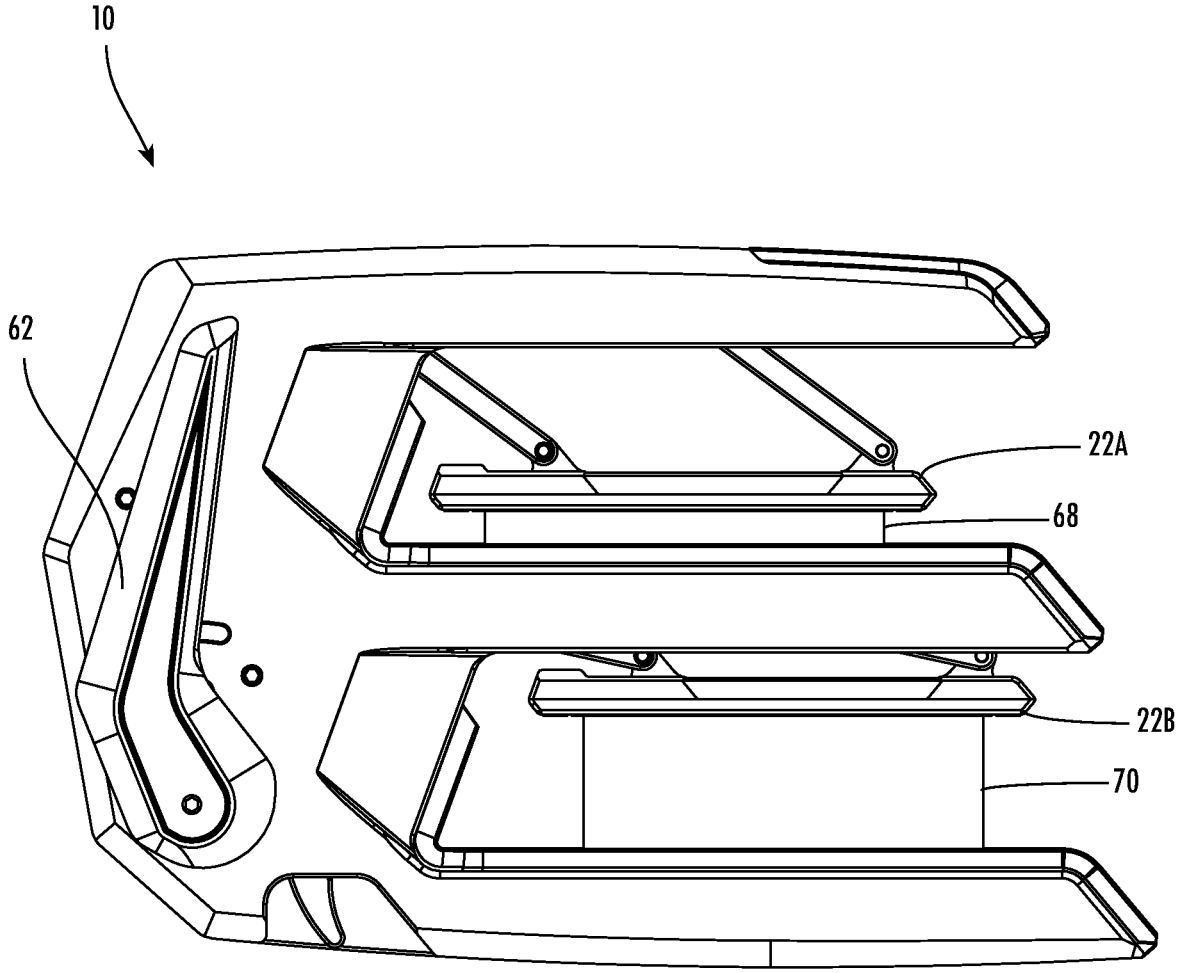
Figure 10:
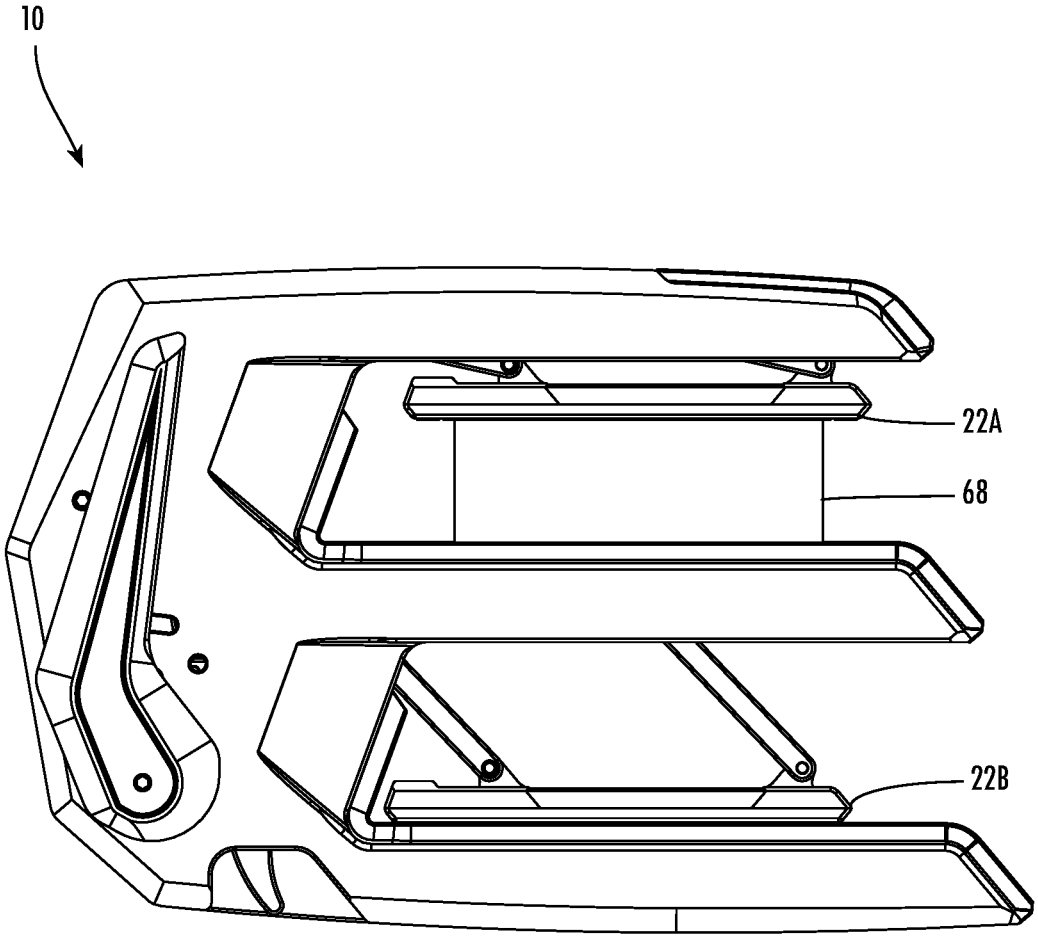
FIG. 10 shows a side view of a storage device engaged with one of a first sports board without a second sports board being located on the storage device.

The storage device 10 allows for objects of varying sizes to be securely stored on the storage device 10. As shown in FIG. 8, a first sports board 68 may be located proximate to the first foot 22A and a second sports board 70 may be located on the storage device 10 proximate to the second foot 22B. The first sports board 68 may have a thickness that is greater than a thickness of the second sports board 70. When the handle 62 is engaged, the first foot 22A extends towards the first sports board 68 and the second foot 22B extends towards the second sports board 70. The first foot 22A may first contact the first sports board 68. After the first foot 22A contacts the first sports board 68, continued actuation of the handle 62 causes the second foot 22B to continue to move towards the second sports board 70. When the second foot 22B subsequently contacts the second sports board 70, continued actuation of the handle 62 causes the first foot 22A to be tightened against the first sports board 68 and the second foot 22B to be tightened against the second sports board 70. As shown in FIG. 9, when the first sports board 68 has a thickness that is less than a thickness of the second sports board 70, the first foot 22A and the second foot 22B may be similarly tightened against both the first sports board 68 and the second sports board 70. Referring to FIG. 10, only one of the first sports board 68 and the second sports board 70 may be stored on the storage device 10.

Two or more of the storage devices 10 may be used to store items thereon. For example, a pair of the storage devices 10 may be used to secure an object such as a sports board at separate portions of the sports board, such as before and after bindings or a center portion of a sports board.

The storage device 10 advantageously secures a sports board, such as a wakesurf board or a wakeboard, on the storage device 10. The storage device 10 allows a sports board to be securely stored on the storage device 10 to substantially prevent the sports board from an undesirable from the storage device 10. The storage device 10 allows for the storage of multiple sports boards having varying thicknesses while securely storing the sports boards with varying thicknesses on the storage device 10. The arrangement of the one or more feet 22 on the storage device 10 with the first linkage 24 and the second linkage 26 provides a secure hold on a sports board when the one or more feet 22 are extended and in contact with a sports board on the storage device 10. Further, the arrangement of the one or more feet 22 on the storage device 10 provides a secure hold on a sports board across a greater area of the sports board when the one or more feet 22 are extended into contact with a sports board. Further, the arrangement of the ratchet member 58 on the storage device 10 enables significant force to be applied to the one or more feet 22 against a sports board to further securely hold a sports board on the storage device.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A sports board storage device, the device comprising:
a housing having a first prong and a second prong;
a first linkage and a second linkage pivotably coupled to the first prong;
a foot pivotably coupled to the first linkage and the second linkage; and
one or more linkage members coupled to the first linkage, wherein the one or more linkage members are movable relative to the housing to cause rotation of the first linkage and the second linkage and to cause the foot to move between a retracted position and an extended position, wherein the foot is closer to the second prong in the extended position than it is in the retracted position.

2. The device of claim 1, wherein the second linkage member is a passive linkage.

3. The device of claim 1, wherein the foot comprises a resiliently flexible or deformable material.

4. The device of claim 1, wherein the first linkage includes a linkage spring for biasing the first linkage and foot toward the retracted position.

5. The device of claim 1, wherein the one or more linkage members comprise an intermediate link member pivotably coupled to the first linkage and slidable relative to the housing, wherein sliding of the intermediate link member causes the foot to move between the retracted position and the extended position.

6. The device of claim 5, wherein the one or more linkage members further comprise a drag link member, wherein the drag link member couples the intermediate link member to the first linkage.

7. The device of claim 1, wherein the housing further comprises a third prong, the foot being a first foot, the device further comprising:
a third linkage and a fourth linkage pivotably coupled to the second prong; and
a second foot pivotably coupled to the third linkage and the fourth linkage,
wherein the one or more linkage members are coupled to the third linkage, wherein the one or more linkage members are movable relative to the housing to cause rotation of the third linkage and the fourth linkage and to cause the second foot to move between a retracted position and an extended position, wherein the second foot is closer to the third prong in the extended position than it is in the retracted position.

8. The device of claim 7, wherein the one or more linkage members comprise an intermediate link member pivotably coupled to the first linkage and the third linkage and slidable relative to the housing, wherein sliding of the intermediate link member causes the first foot and the second foot to move between the retracted positions and the extended positions.

9. The device of claim 8, wherein the intermediate link member has a first portion, a second portion spaced apart from the first portion, and an intermediate portion located between the first portion and the second portion, wherein the first linkage is pivotably coupled to the first portion and the third linkage is pivotably coupled to the second portion, wherein the intermediate link member is pivotable about the intermediate portion relative to the housing.

10. A sports board storage device, the device comprising:
a housing having a first prong and a second prong;
one or more linkages pivotably coupled to the first prong;
a foot pivotably coupled to the one or more linkages;
one or more linkage members coupled to at least one of the one or more linkages, wherein the one or more linkage members are movable relative to the housing to cause rotation of the one or more linkages and to cause the foot to move between a retracted position and an extended position, wherein the foot is closer to the second prong in the extended position than it is in the retracted position; and
a ratchet for causing the one or more linkage members to move relative to the housing.

11. The device of claim 10, wherein the one or more linkages include a linkage spring for biasing the one or more linkages and foot toward the retracted position.

12. The device of claim 10, wherein the one or more linkage members comprise an intermediate link member pivotably coupled to the one or more linkages and slidable relative to the housing, wherein sliding of the intermediate link member causes the foot to move between the retracted position and the extended position.

13. The device of claim 12, wherein the one or more linkage members further comprise a drag link member, wherein the drag link member couples the intermediate link member to the one or more linkages.

14. The device of claim 10, wherein the ratchet includes a drum rotatable relative to the housing and a cable coupled to the one or more linkage members, wherein rotation of the drum causes the cable to wind around the drum.

15. The device of claim 14, wherein the ratchet further comprises a ratchet member slidable relative to the housing, wherein the ratcheting member is further rotatable relative to the housing between an engaged position and a disengaged position, wherein the ratchet member is engaged with the drum such that sliding of the ratchet member causes rotation of the drum in the engaged position and the ratchet member is disengaged with the drum in the disengaged position.

16. The device of claim 15, wherein the ratchet defines one or more teeth and the drum defines one or more teeth, wherein the teeth of the ratchet member engage the teeth of the drum in the engaged position.

17. The device of claim 15, wherein the ratchet further comprises a handle coupled to the ratchet member.

18. The device of claim 15, wherein the ratchet further comprises a ratchet spring for biasing the ratchet member toward the engaged position.

19. The device of claim 18, wherein the ratchet further comprises a ratchet pin configured to contact the ratchet member when the ratchet member is slid relative to the housing, wherein contact with the ratchet pin urges the ratchet member toward the disengaged position.

20. The device of claim 19, wherein the ratchet further comprises a release lever movable relative to the housing, wherein the release lever is movable between a hold position and a release position, wherein the release lever is engaged with the drum to allow rotation of the drum in a first rotational direct and prevent rotation of the drum in a second rotational direction in the hold position and the release lever is disengaged with the drum to allow rotation of the drum in the first rotational direct and the second rotational direction in the release position.

21. The device of claim 20, wherein the ratchet further comprises a release lever spring for biasing the release lever toward the hold position.

* * * * *